US012747001B2

(12) United States Patent
Vink et al.

(10) Patent No.: US 12,747,001 B2
(45) Date of Patent: Sep. 29, 2026

(54) WATER CRAFT AND METHOD FOR MANUFACTURING SUCH A WATER CRAFT

(71) Applicant: X-Treme Yachts B.V., Sliedrecht (NL)

(72) Inventors: Jan Vink, Sliedrecht (NL); Tjerko Onno Jurgens, Sliedrecht (NL)

(73) Assignee: X-Treme Yachts B.V., Sliedrecht (NL)

( * ) Notice: Subject to any disclaimer, the term of this patent is extended or adjusted under 35 U.S.C. 154(b) by 734 days.

(21) Appl. No.: 18/087,284

(22) Filed: Dec. 22, 2022

(65) Prior Publication Data

US 2023/0192236 A1 Jun. 22, 2023

Related U.S. Application Data

(60) Provisional application No. 63/292,853, filed on Dec. 22, 2021.

(30) Foreign Application Priority Data

Dec. 22, 2021 (NL) ..... 2030224

(51) Int. Cl.
*B63B 35/40* (2006.01)
*B63B 1/04* (2006.01)
(Continued)

(52) U.S. Cl.
CPC ..... *B63B 1/04* (2013.01); *B63B 3/40* (2013.01); *B63B 3/48* (2013.01)

(58) Field of Classification Search
None
See application file for complete search history.

(56) References Cited

U.S. PATENT DOCUMENTS 3,508,510 A 4/1970 Frankel
4,747,362 A * 5/1988 Olsen ..... E04H 4/0012 114/264
(Continued)

FOREIGN PATENT DOCUMENTS

CN 108945323 A * 12/2018 ..... E04H 4/065
CN 211032935 U * 7/2020
(Continued)

OTHER PUBLICATIONS

Search Report from Netherlands Application No. NL 2030224, Sep. 5, 2022.

*Primary Examiner* — Kayla Mccaffrey
(74) *Attorney, Agent, or Firm* — Workman Nydegger

(57) ABSTRACT

Water craft comprising a hull, with an opening and a lowerable segment arranged in said opening. The lowerable segment is coupled to the hull via a lifting mechanism for lowering or raising the lowerable segment with respect to the hull between a first position in which an outer surface of a bottom wall of the segment is substantially flush with the outer surface of a bottom of the hull adjacent to the segment, and a second position wherein the segment is arranged below the water line of the hull. The lowerable segment comprises a lower watertight compartment and an upper compartment that can at least partially be filled with water when the segment is lowered and can be drained when the segment is raised. When in the first position, a wall between the lower and upper compartment is arranged at a level at or near the water line.

15 Claims, 4 Drawing Sheets

(51) Int. Cl.
*B63B 3/40* (2006.01)
*B63B 3/48* (2006.01)

(56) References Cited

U.S. PATENT DOCUMENTS

| | | | | |
|---|---|---|---|---|
| 6,843,198 | B1 | 1/2005 | Witbeck | |
| 9,611,008 | B1 * | 4/2017 | O'Neal | B63B 3/48 |
| 9,630,685 | B2 * | 4/2017 | Lykov | B63B 35/44 |
| 2010/0089302 | A1 | 4/2010 | Muller | |
| 2022/0371689 | A1 * | 11/2022 | Cambria | B63B 27/14 |

FOREIGN PATENT DOCUMENTS

| | | | | |
|---|---|---|---|---|
| EP | 2886440 | B1 | | 2/2017 |
| EP | 2903888 | B1 | | 4/2017 |
| JP | 61110691 | A | * | 5/1986 |

* cited by examiner

WATER CRAFT AND METHOD FOR MANUFACTURING SUCH A WATER CRAFT

BACKGROUND

The invention relates to a water craft comprising a lowerable element, wherein the lowerable element is coupled to the hull via a lifting mechanism.

Such a lowerable element, commonly provided as a lowerable platform, can be used for putting a tender in the water and for parking and securing the tender in dry condition on the raised platform when not is use.

US 2010/0089302 A1 discloses a lowerable platform for attachment on the stern of a water craft, wherein the platform comprises buoyancy means for keeping the lowerable platform unaided above the water line The platform can be lowered against the buoyance force with a working cylinder having a thrust force to lower the platform below the water line. The buoyancy means help to absorb the tare weight of the platform and/or the weight of the useful load on the platform by means of floats.

SUMMARY OF THE INVENTION

It is an object of the present invention to provide at least an alternative for the lowerable platform.

According to a first aspect, the present invention provides a water craft comprising a hull, wherein the water craft comprises first water line at lightweight displacement of the water craft and a second water line at full load displacement of the water craft, wherein the hull comprises an opening and a lowerable segment arranged in said opening, wherein the lowerable segment is coupled to the hull via a lifting mechanism, wherein the lifting mechanism is configure to lower or raise the lowerable segment with respect to the hull between

- a first position in which an outer surface of a bottom wall of the lowerable segment is substantially flush with a part of the outer surface of a bottom of the hull adjacent to the lowerable segment, wherein the lowerable segment extends in a substantially vertical direction between the bottom of the hull to a position above the second water line of the hull, and
- a second position in which an outer surface of a bottom wall of the lowerable segment is arranged below said part of the outer surface of a bottom of the hull adjacent to the lowerable segment, in particular wherein the lowerable segment is arranged below the second water line of the water craft,
- wherein the lowerable segment comprises a substantially horizontal partition plate which divides the lowerable segment in a lower compartment and an upper compartment, wherein the lower compartment is substantially watertight,
- wherein the upper compartment is configured to be at least partially filled with water when the lowerable segment is lowered from the first position, and wherein the upper compartment is configured to be drained when the lowerable segment is raised to the first position, and
- wherein, when the lowerable segment is in the first position, the partition plate is arranged substantially at a level in a range including and between the first and second water line of the water craft.

Firstly, and contrarily to the lowerable platform as described in US 2010/0089302 A1, the lowerable segment of the present invention is configured to be an integral part of the hull of the water craft, at least when the lowerable segment is in the first position:

In the first position, the outer surface of a bottom wall of the lowerable segment is substantially flush with the part of the outer surface of the bottom of the hull adjacent to the lowerable segment. Accordingly, in the first position, the outer surface of the bottom wall of the lowerable segment forms an integral part of the outer surface of the bottom wall of the hull and providing less water turbulence at the transition between the lowerable segment and the adjacent parts of the hull, which reduces drag.

Secondly, the hull of the water craft comprises an opening, wherein the lowerable segment is arranged in said opening. By arranging the lowerable segment in an opening of the hull, the lowerable segment does not disturb the balance of the water craft, at least when the lowerable segment is in the first position, as compared to the attachment of a lowerable platform to the stern of a watercraft.

Furthermore, by configuring the lowerable segment to comprise a substantially horizontal partition plate which divides the lowerable segment in a lower compartment and an upper compartment, wherein the lower compartment is substantially watertight, and wherein the upper compartment is configured to be at least partially filled with water when the lowerable segment is lowered from the first position, and wherein the upper compartment is configured to be drained when the lowerable segment is raised to the first position, the upper compartment of the lowerable segment will not add any buoyance to the water vessel when the lowerable segment is submerged.

It is noted that the water line of a water craft is the line between the part of the hull which is under water and the part of the hull that is above the surface of the water, or in other words, it is the line where the hull of the water craft meets the surface of the water. The position of the water line depends, inter alia, on the shape of the hull and on the loading of the water craft. The position varies by a water craft's degree of load, from its empty weight (described herein as lightweight displacement, also known as 'lightweight tonnage' or 'light displacement (LDT)') to its full load. Accordingly, we define herein:

- a first water line of the water craft at lightweight displacement of the water craft. The lightweight displacement is the displacement of the water craft excluding cargo, fuel, water, ballast, stores, passengers and crew, and represents a minimum draft of the water craft;
- a second water line of the water craft at full load displacement of the water craft. The full load displacement is the displacement of a water craft when floating at its greatest allowable draft in order to ensure that the water craft has sufficient freeboard and has sufficient reserve buoyancy, and thus represents a maximum draft of the water craft.

It is noted that the first water line and the second water line are design features of the water craft.

According to the present invention, the partition plate is arranged substantially at a level in a range including and between the first and second water line of the water craft, when the lowerable segment is in the first position. As a result, the buoyancy of the lowerable segment in the second position is close to or substantially the same as the buoyancy of the lowerable segment in the first position. Accordingly, this reduces a disturbance of the balance and/or buoyancy of the water craft when the lowerable segment is moved from the first towards the second position.

In an embodiment, the partition plate is arranged substantially at a level at the water line at normal load displacement, standard displacement or designed load displacement of the water craft, when the lowerable segment is in the first position. The normal load displacement is the displacement of a water craft with all outfit and two-thirds supply of stores. The standard displacement is the displacement of the water craft fully manned, engine and equipped ready for sea, including, inter alia, equipment, outfit, provisions and fresh water for the crew. It is noted that the water line at normal load displacement, standard displacement or designed load displacement is in the range between the first and second water line as defined above. In this embodiment, the partition plate is arranged close to the water line of normal or designed use of the watercraft. As a result, the buoyancy of the lowerable segment in the second position is even closer to or substantially the same as the buoyancy of the lowerable segment in the first position. Accordingly, this further reduces a disturbance of the balance and/or buoyancy of the water craft when the lowerable segment is moved from the first towards the second position.

In an embodiment, at least in the first position, an outer surface of a side wall of the lowerable segment forms a part of the outer surface of a stern of the hull. In this embodiment, the opening in the hull is at least open to the stern and a tender may move into the opening in the hull via the stern, at least when the lowerable segment is submerged.

Preferably, the second position is configured such that an upper side of the lowerable segment is position about 0.6 to 2.5 meters below the water line of the hull. Since most tenders have a draught that is less than 1.5 meters, these tenders can navigate into the opening to a position above the lowerable segment. Subsequently, the lowerable segment can be raised back to the first position together with the tender. Accordingly, the tender can be parked and secured in dry condition on top of the lowerable segment.

In an embodiment, the position above the water line of the hull to which the lowerable segment extends is at or near a deck of the water craft adjacent to the lowerable segment. Accordingly, when the lowerable segment is in the first position, the upper part of the lowerable segment is substantially at the same level as the deck of the water craft adjacent to the lowerable segment.

In an embodiment, at least in the first position, the outer surface of the side wall of the lowerable segment is arranged between a port side part and a starboard side part of the stern of the hull. Accordingly, in a direction substantially transverse to the longitudinal direction of the water craft, the opening in the hull is arranged in a center part of the hull, in such a way that the opening is sandwiched between a port side part and a starboard side part of the hull. In addition, the opening is open to the stern of the hull. Accordingly, a tender can navigate into the opening by in a direction substantially parallel to the longitudinal direction of the water craft to enter the opening via the stern of the water craft.

In an embodiment, the lowerable segment is arranged substantially midships of the hull, at least in a direction substantially perpendicular to the longitudinal direction of the water craft. Accordingly, the lowerable segment is substantially arranged on the center line of the water craft, and also the tender in its parked and secured position on top of the lowerable segment can be arranged substantially on the center line so that the transverse balance of the water craft does not change when a tender is position on said lowerable segment, at least when compared with the situation when there is no tender on said lowerable segment.

Preferably, the opening in the hull comprises an elongated opening and the lowerable segment comprises a corresponding elongated lowerable segment, wherein a longitudinal direction of the opening and the lowerable segment is arranged substantially parallel to a center line of the hull of the water craft and/or substantially perpendicular to the stern of the hull of the water craft.

In an embodiment, the length of the elongated opening and lowerable segment is larger than the width of the hull of the water craft. Accordingly, the lowerable segment according to this embodiment of the invention allows to park and secure a relatively large tender on said lowerable segment. Even a tender that is longer than the width of the hull of the water craft can be parked and secured on top of the lowerable segment without any part of the tender protruding beyond the hull of the water craft.

In an embodiment, the lowerable segment comprises a holding member for a tender, wherein said holding member is arranged on an upper side of the lowerable segment. Preferably, the holding member comprises a tender mount, preferably comprising retaining brackets for securing the tender on the tender mount.

In addition or alternatively, in an embodiment, the upper compartment comprises a pool, wherein said pool is provided with a closing member, such as a cock or valve, wherein, when the closing member is in a closed configuration, the closing member is configured to retain water in the pool, and when the closing member is in an open configuration, the closing member is configured to allow water to flow into or out of the pool. The lowerable segment of the present invention can be submerged and the upper compartment, including the pool, can be filled with water in which the water craft floats. When the lowerable segment is subsequently moved back in the first position and the water in the pool is retained, the water craft of the invention now comprises a water filled pool ready for use as a swimming and/or relaxing pool. When the pool is no longer needed, the closing member can be opened and the water can flow out of the pool, preferably back to the surrounding water in which the water craft is floating. Accordingly, the pool in the upper compartment of the lowerable member can easily be filled on demand by surrounding water and can easily be emptied. Accordingly, this pool can be operated without an elaborate system for continuously filtering of the water in the pool.

Although the pool may be arranged below deck, it is preferred that, in an embodiment, said pool is open or accessible at an upper side of the lowerable segment. Accordingly, the pool is easily accessible from the deck of the water craft.

In an embodiment, the pool comprises a pool deck and/or adjustable pool floor. Accordingly, the pool can be covered by the pool deck, for example when not in use. In addition, or alternatively, the adjustable pool floor can be set to a desired depth. Preferably, closing member, the pool deck and/or the closing member is provided with a filter member for filtering the water that flows into the pool.

In an embodiment, the adjustable pool deck and/or adjustable pool floor comprises said holding member for a tender. This embodiment allows to use the pool or pool deck to park and/or secure a tender, at least when the pool is not in use.

According to a second aspect, the present invention provides a method for manufacturing a water craft, wherein the method comprises the steps of:

- manufacturing a hull, wherein the hull comprises an opening which extends from the bottom of the hull up to at least a position above the water line of the hull;
- manufacturing a segment which fits in said opening in the hull, wherein said segment is configured to be positioned in a first position in which an outer surface of a bottom wall of the segment is flush with a part of the outer surface of a bottom of the hull adjacent to the segment, wherein the segment extends in a substantially vertical direction between the bottom of the hull to the position above a water line of the hull, wherein the segment comprises a substantially horizontal partition plate which divides the segment in a lower compartment and an upper compartment, wherein the lower compartment is substantially watertight, wherein the upper compartment is configured to be at least partially filled with water when the segment is lowered from the first position, and wherein the upper compartment is configured to be drained when the lowerable segment is raised to the first position, and wherein, when the lowerable segment is in the first position, the partition plate is arranged substantially at a level in a range including and between a first water line at lightweight displacement of the water craft and a second water line at full load displacement of the water craft; and positioning the segment in the opening of the hull and coupling the segment to the hull via a lifting mechanism, wherein the lifting mechanism is configured to lower or raise the segment with respect to the hull between the first position, and a second position in which the segment is arranged below the second water line of the water craft.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached drawings, in which.

DETAILED DESCRIPTION OF THE INVENTION

Figure 1:
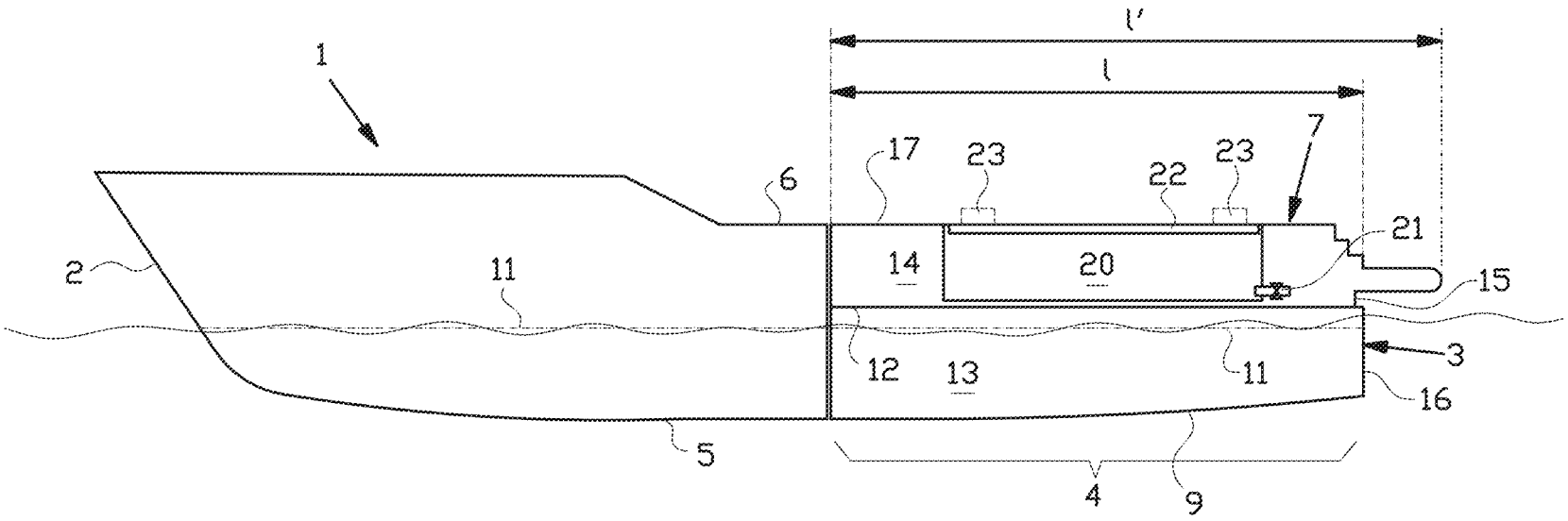
FIG. 1 is a schematic cross-section in a longitudinal direction of a vessel according to the present invention, with the lowerable segment in the first position.
Figure 2:
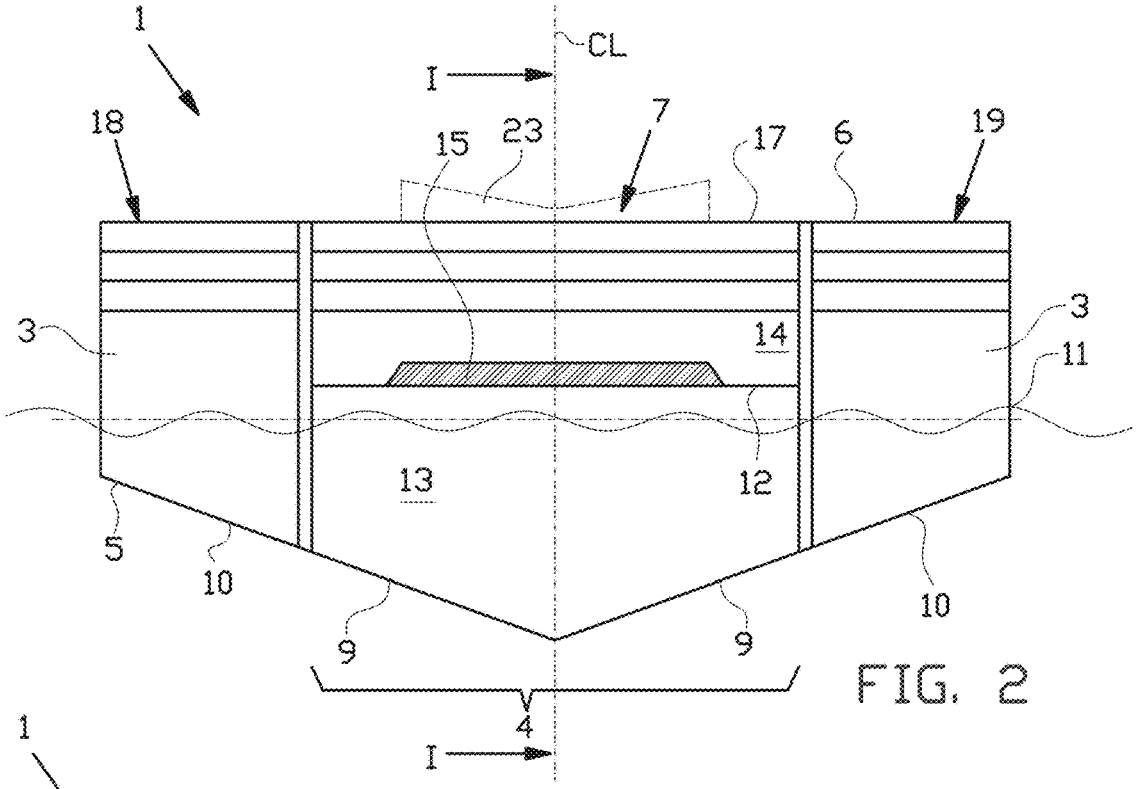
FIG. 2 is a schematic view of the stern of the vessel of FIG. 1.

FIG. 1 schematically shows a schematic cross-section in a longitudinal direction of an example of a hull of a water craft 1 according to the present invention. In this particular example, the water craft 1 is a vessel. The cross-section shows the hull from bow 2 to stern 3. FIG. 2 schematically shows a view of the stern 3 of the vessel of FIG. 1 and the line I-I in FIG. 2 indicates the position of the schematic cross-section of FIG. 1.

The water craft 1 comprises a substantially rectangular opening 4, which is schematically shown in FIGS. 1 and 2. The opening 4 reaches from the bottom 5 of the hull up to the deck 6 adjacent to the opening 4. In the opening 4, a lowerable segment 7 is arranged. The position in vertical direction above the water line 11 of the water craft 1 to which the lowerable segment 7 extends, is at or near a deck 6 of the water craft 1 adjacent to the lowerable segment 7.

Figure 4:
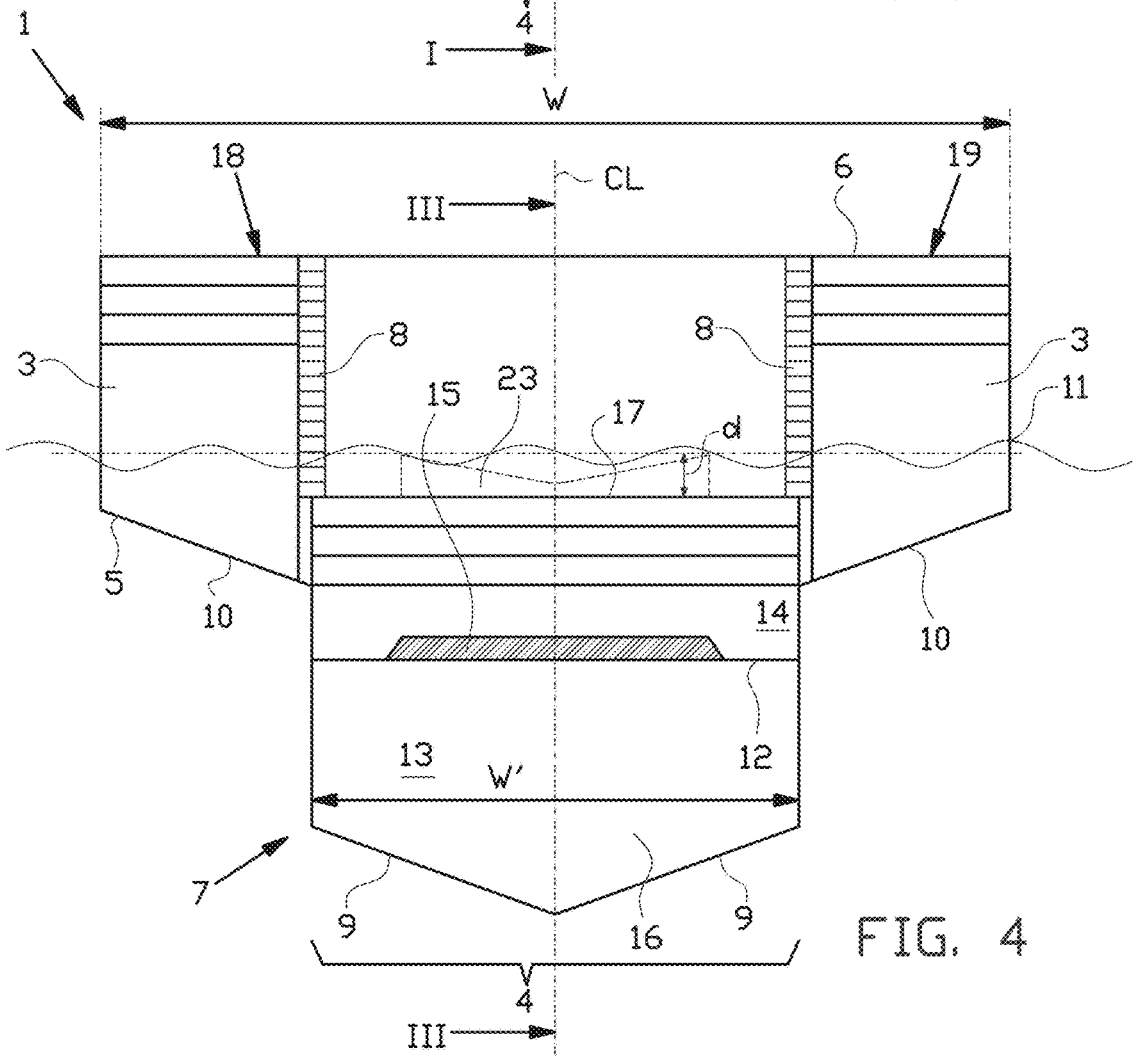
FIG. 4 is a schematic view of the stern of the vessel of FIG. 2.
Figure 3:
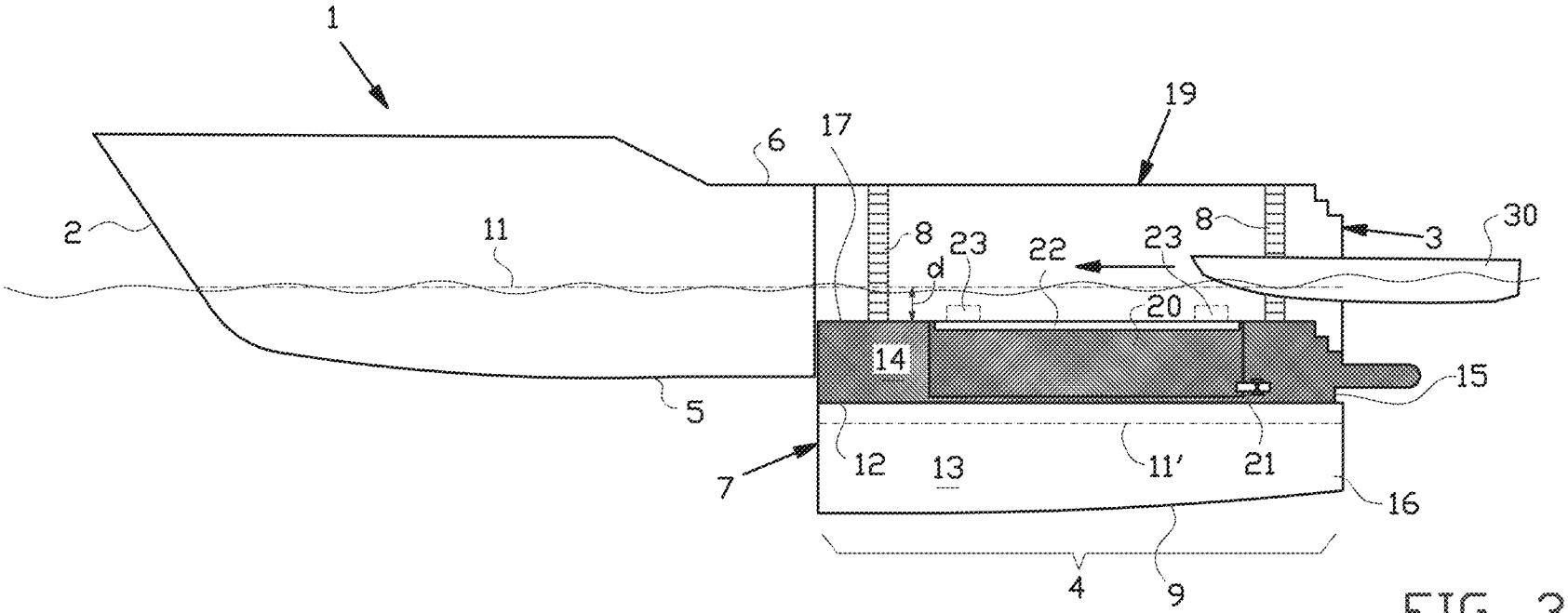
FIG. 3 is a schematic cross-section of in the longitudinal direction of the vessel of FIG. 1, with the lowerable segment in a second position.

The lowerable segment 7 is coupled to the hull via a lifting mechanism 8, as schematically shown in FIGS. 3 and 4, wherein the lifting mechanism 8 is configured to lower or raise the lowerable segment 7 with respect to the hull between a first position and a second position.

FIGS. 1 and 2 schematically show the lowerable segment 7 in the first position in which an outer surface 9 of a bottom wall of the lowerable segment 7 is substantially flush with a part of the outer surface 10 of a bottom 5 of the hull of the water craft 1 adjacent to the lowerable segment 7. The lowerable segment 7 extends in a substantially vertical direction between the bottom 5 of the hull to a position above a water line 11 of the water craft 1. In this first position, an outer surface 16 of a side wall of the lowerable segment 7 forms a part of the outer surface of the stern 3 of the hull. Accordingly, the opening 4 in the hull is at least open to the stern 3 and a tender 30 may move into the opening 4 in the hull of the water craft 1 via the stern 3, at least when the lowerable segment 7 is submerged, as shown in FIG. 3.

FIGS. 3 and 4 schematically show the lowerable segment 7 in the second position, in which the outer surface 9 of a bottom wall of the lowerable segment 7 is arranged below said part of the outer surface 10 of a bottom 5 of the hull adjacent to the lowerable segment 7, in particular wherein the lowerable segment 7 is arranged below the water line 11 of the water craft 1. In the second position, an upper side 17 of the lowerable segment 7 is positioned at a distance d=0.6 to 2.5 meters below the water line of the water craft 1. Since most tenders 30 have a draught that is less, these tenders 30 can navigate into the opening 4 to a position above the lowerable segment 7. Subsequently, the lowerable segment 7 can be raised back to the first position together with the tender 30. Accordingly, the tender 30 can be parked and secured in dry condition on top of the lowerable segment 7. In an embodiment, the lowerable segment comprises a holding member 23 for a tender, wherein said holding member is arranged on an upper side of the lowerable segment. Preferably, the holding member 23 comprises a tender mount, preferably comprising retaining brackets for securing the tender on the tender mount.

As schematically shown in FIG. 1, the lowerable segment 7 comprises a substantially horizontal partition plate 12 which divides the lowerable segment 7 in a lower compartment 13 and an upper compartment 14. The lower compartment 13 is substantially watertight and is filled with air. The lower compartment 13 is substantially watertight and both the lower compartment 13 and the partition plate 12 extend over substantially the whole width w' of the segment 7 as shown in FIGS. 2 and 4.

The upper compartment 14 is configured to be at least partially filled with water when the lowerable segment 7 is lowered from the first position and is configured to be drained when the lowerable segment 7 is raised to the first position. Accordingly, the upper compartment 14 comprises a water inlet/outlet 15, which in this example is arranged at the stern 3 of the hull 1.

According to the present invention, the partition plate 12 is arranged substantially at a level in a range including and between the first and second water line of the water craft, when the lowerable segment 7 is in the first position. As a result, the buoyancy of the lowerable segment 7 in the second position is close to or substantially the same as the buoyancy of the lowerable segment in the first position.

In the example of FIG. 1, the partition plate 12 is arranged at or close to the second water line, whereas the water craft is not loaded to full load. Accordingly, the partition plate 12 is at a level above the actual water line 11 of the hull 1, at least when the lowerable segment 7 is in the first position. It is noted that when the partition plate 12 would be arranged at or close to the first water line and the water craft would be loaded to normal or full load, the partition plate 12 would be at a level below the actual water line of the hull, at least when the lowerable segment is in the first position.

Furthermore, in the example and as shown in FIGS. 2 and 4, the lowerable segment 7 is arranged between a port side part 18 and a starboard side part 19 of the hull of the water craft 1. preferably, in a direction substantially transverse to the longitudinal direction of the water craft, the opening 4 in the hull is arranged in a center part of the hull, in such a way that the opening 4 is sandwiched between a port side part 18 and a starboard side part 19 of the hull of the water craft 1. In addition, the opening 4 is open to the stern 3 of the hull 1. Accordingly, the tender 30 can navigate into the opening 4 by moving in a direction substantially parallel to the longitudinal direction of the water craft to enter the opening via the stern 3 of the water craft.

As schematically shown in FIGS. 2 and 4, the lowerable segment 7 is arranged substantially midships of the hull of the water craft 1, at least in the direction substantially perpendicular to the longitudinal direction of the hull. Accordingly, the lowerable segment 7 is substantially arranged on the center line CL of the hull. As a result, also the tender 30 in its parked and secured position on top 17 of the lowerable segment 7 can be arranged substantially on the center line CL so that the balance of the water craft in a substantially transvers direction of the hull 1 does not change when a tender 30 is position on said lowerable segment 7 or not.

Furthermore, as schematically shown in FIGS. 1 and 3, the opening 4 in the hull 1 comprises an elongated opening and the lowerable segment 7 comprises a corresponding elongated lowerable segment. The longitudinal direction of the opening 4 and the lowerable segment 7 is arranged substantially parallel to a longitudinal center line of the hull of the water craft 1 and substantially perpendicular to the stern 3 of the hull of the water craft 1. In the example of FIGS. 1 and 3, both the opening 4 and the lowerable segment 7 extend over a significant part of the length of the hull.

The length 1 of the elongated opening 4 and the length l' lowerable segment 7 are larger than the width w of the hull of the water craft 1. Accordingly, the lowerable segment 7 according to the example of the invention shown in the figures allows to park and secure a relatively large tender 30 on said lowerable segment 7. Even a tender 30 that is longer than the width w of the hull of the water craft 1 can be parked and secured on top of the lowerable segment 7 without any part of the tender 30 protruding beyond the hull of the water craft 1.

In addition, or alternatively, in a further example, the upper compartment 14 of the water craft of the present invention, comprises a pool 20. Said pool 20 is provided with a closing member 21, such as a cock or valve. When the closing member 21 is in a closed configuration, the closing member is configured to retain water in the pool 20. When the closing member 21 is in an open configuration, the closing member is configured to allow water to flow into or out of the pool 20.

Figure 5:
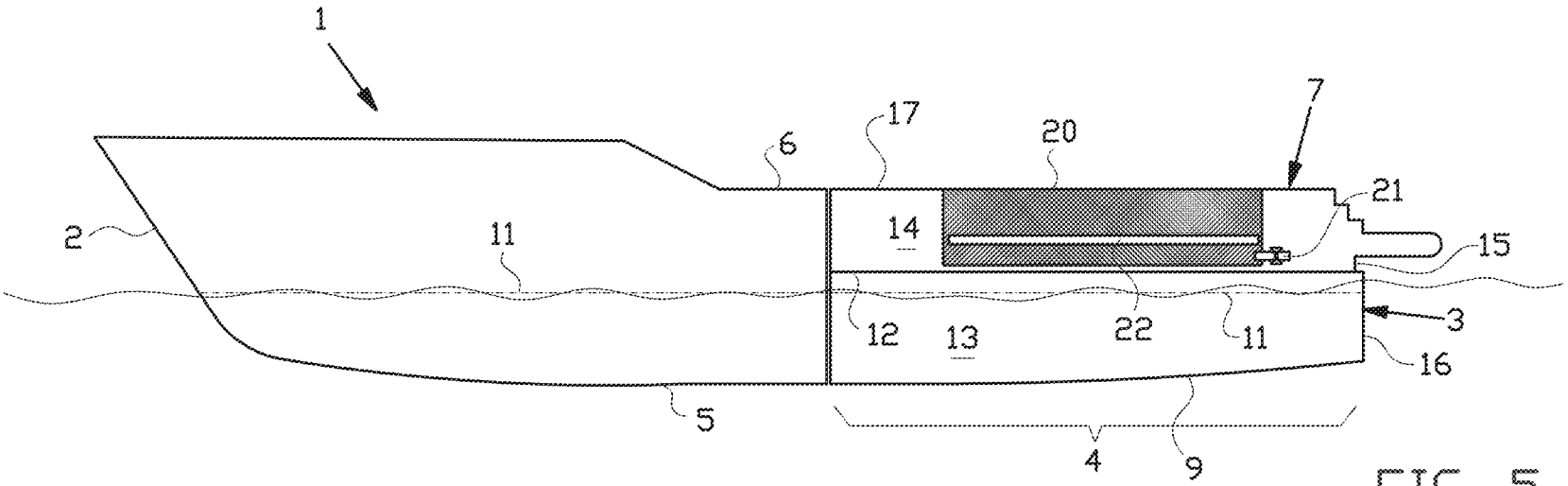
FIG. 5 is a schematic cross-section of in the longitudinal direction of the vessel of FIG. 1, with the lowerable segment back in the first position with a filled pool.

As schematically shown in FIG. 3, the lowerable segment 7 can be submerged and the upper compartment 14, including the pool 20, can be filled with water in which the water craft floats. When the lowerable segment 7 is subsequently moved back in the first position, as shown in FIG. 5, and the closing member 21 is in the closed configuration, the water craft of the invention now comprises a water filled pool 20 ready for use as a swimming and/or relaxing pool. When the pool 20 is no longer needed, the closing member 21 can be opened and the water can flow out of the pool 20, back to the surrounding water in which the water craft is floating. Accordingly, the pool 20 in the upper compartment 14 of the lowerable member 7 can easily be filled on demand by surrounding water and can easily be emptied. Accordingly, this pool 20 can be operated without an elaborate system for continuously filtering of the water in the pool 20.

Although the pool may be arranged below deck, it is preferred that, as shown in FIG. 5, said pool 20 is open or accessible at an upper side of the lowerable segment 7. Accordingly, the pool 20 is easily accessible from the deck 6 of the water craft.

Preferably, the pool comprises a pool deck and/or adjustable pool floor 22. Accordingly, the pool 20 can be covered by the pool deck and/or adjustable pool floor 22, for example when not in use. In addition, the adjustable pool floor 22 can be set to a desired depth, as schematically shown in FIG. 5.

Preferably, the pool deck 22 and/or the closing member 21 is provided with a filter member for filtering the surrounding water before it flows into the pool 22. Such a filter member for example comprises a screen of sieve. In particular, when the filter member is arranged in connection to or in the closing member 21, the filter member is rinsed each time the pool 20 is emptied and any objects on the filter member is washed away with the outflowing water.

The water craft 1 of the present invention is preferably manufactured by using a method comprises the steps of:

manufacturing a hull, wherein the hull comprises an opening 4 which extends from the bottom 5 of the hull up to at least a position above the water line 11 of the hull 1;

manufacturing a segment 7 which fits in said opening 4 in the hull, wherein said segment 7 is configured to be positioned in a first position (see FIGS. 1 and 2) in which an outer surface 9 of a bottom wall of the segment 7 is flush with a part 10 of the outer surface of a bottom 5 of the hull adjacent to the segment 7, wherein the segment 7 extends in a substantially vertical direction between the bottom 5 of the hull to the position above a water line 11 of the hull 1, wherein the segment comprises a substantially horizontal partition plate 12 which divides the segment 7 in a lower compartment 13 and an upper compartment 14, wherein the lower compartment 13 is substantially watertight and extends over substantially the whole width of the segment 7, wherein the upper compartment 14 is configured to be at least partially filled with water when the segment 7 is lowered from the first position (see FIGS. 3 and 4), and wherein the upper compartment 14 is configured to be drained when the lowerable segment 7 is raised to the first position, and wherein, when the lowerable segment 7 is in the first position, the partition plate 12 is arranged substantially at a level in a range including and between a first water line at lightweight displacement of the water craft 1 and a second water line at full load displacement of the water craft 1; and positioning the segment 7 in the opening 4 of the hull and coupling the segment 7 to the hull via a lifting mechanism 8, wherein the lifting mechanism 8 is configured to lower or raise the segment 7 with respect to the hull between the first position, and a second position in which the segment 7 is arranged below the second water line 11 of the hull 1.

Preferably, the partition plate 12 is arranged substantially at a level at or near the actual water line 11 of the hull 1, when the lowerable segment 7 is in the first position, for example by arranging the partition plate 12 substantially at a level at the water line at normal load displacement, standard displacement or designed load displacement of the water craft 1, when the lowerable segment 7 is in the first position.

In summary, the invention relates to a water craft comprising a hull, with an opening and a lowerable segment arranged in said opening. The lowerable segment is coupled to the hull via a lifting mechanism for lowering or raising the lowerable segment with respect to the hull between a first position in which an outer surface of a bottom wall of the segment is substantially flush with the outer surface of a bottom of the hull adjacent to the segment, and a second position wherein the segment is arranged below the water line of the hull.

The lowerable segment comprises a lower watertight compartment and an upper compartment that can at least partially be filled with water when the segment is lowered and can be drained when the segment is raised. When in the first position, a wall between the lower and upper compartment is arranged at a level at or near the water line.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. A water craft comprising:

a hull;

a first water line at lightweight displacement of the water craft; and a second water line at full load displacement of the water craft, wherein the hull comprises an opening and a lowerable segment arranged in said opening, wherein the lowerable segment is coupled to the hull via a lifter, wherein the lifter is configured to lower or raise the lowerable segment with respect to the hull between a first position in which an outer surface of a bottom wall of the lowerable segment is substantially flush with a part of the outer surface of a bottom of the hull adjacent to the lowerable segment, wherein the lowerable segment extends in a substantially vertical direction between the bottom of the hull to a position above the second water line of the hull, and a second position in which an outer surface of the bottom wall of the lowerable segment is arranged below said part of the outer surface of the bottom of the hull adjacent to the lowerable segment, wherein the lowerable segment is arranged below the second water line of the water craft, wherein the lowerable segment comprises a substantially horizontal partition plate which divides the lowerable segment in a lower compartment and an upper compartment, wherein the lower compartment is substantially watertight, wherein the upper compartment is configured to be at least partially filled with water when the lowerable segment is lowered from the first position, and wherein the upper compartment is configured to be drained when the lowerable segment is raised to the first position, and wherein, when the lowerable segment is in the first position, the partition plate is arranged substantially at a level in a range including and between the first and second water line of the water craft.

2. The water craft according to claim 1, wherein the partition plate is arranged substantially at a level at the water line at normal load displacement, standard displacement or designed load displacement of the water craft, when the lowerable segment is in the first position.

3. The water craft according to claim 1, wherein, at least in the first position, an outer surface of a side wall of the lowerable segment forms a part of the outer surface of a stern of the hull.

4. The water craft according to claim 1, wherein the position above the water line of the hull to which the lowerable segment substantially extends is at or near a deck of the water craft adjacent to the lowerable segment.

5. The water craft according to claim 1, wherein, at least in the first position, the outer surface of the side wall of the lowerable segment is arranged between a port side part and a starboard side part of the stern of the hull.

6. The water craft according to claim 5, wherein the lowerable segment is arranged substantially midships of the hull.

7. The water craft according to claim 1, wherein the lowerable segment comprises a holding member for a tender, wherein said holding member is arranged on an upper wall of the lowerable segment.

8. The water craft according to claim 7, wherein the holding member for the tender comprises a chock.

9. The water craft according to claim 1, wherein the upper compartment comprises a pool, wherein said pool is provided with a closing member, wherein, when the closing member is in a closed configuration, the closing member is configured to retain water in the pool, and when the closing member is in an open configuration, the closing member is configured to allow water to flow into or out of the pool.

10. The water craft according to claim 9, wherein said pool is open or accessible at an upper side of the lowerable segment.

11. The water craft according to claim 9, wherein the pool comprises an adjustable pool deck and/or adjustable pool floor.

12. The water craft according to claim 9, wherein the closing member comprises a cock or a valve.

13. The water craft according to claim 11, wherein the lowerable segment comprises a holding member for a tender, such as a chock, wherein said holding member is arranged on the adjustable pool deck and/or adjustable pool floor.

14. The water craft according to claim 13, wherein the holding member for the tender comprises a chock.

15. A method for manufacturing a water craft, the method comprising the steps of:

manufacturing a hull, wherein the hull comprises an opening which extends from the bottom of the hull up to at least a position above the water line of the hull;

manufacturing a segment which fits in said opening in the hull, wherein said segment is configured to be positioned in a first position in which an outer surface of a bottom wall of the segment is flush with a part of the outer surface of a bottom of the hull adjacent to the segment, wherein the segment extends in a substantially vertical direction between the bottom of the hull to the position above a water line of the hull, wherein the segment comprises a substantially horizontal partition plate which divides the segment in a lower compartment and an upper compartment, wherein the lower compartment is substantially watertight, wherein the upper compartment is configured to be at least partially filled with water when the segment is lowered from the first position, and wherein the upper compartment is configured to be drained when the lowerable segment is raised to the first position, and wherein, when the lowerable segment is in the first position, the partition plate is arranged substantially at a level in a range including and between a first water line at lightweight displacement of the water craft and a second water line at full load displacement of the water craft, positioning the segment in the opening of the hull and coupling the segment to the hull via lifter, wherein the lifter is configured to lower or raise the segment with respect to the hull between the first position, and a second position in which the segment is arranged below the second water line of the water craft.

* * * * *